United States Patent [19]

Moudgil et al.

[11] 4,326,950

[45] * Apr. 27, 1982

[54] PROCESS FOR SEPARATING OIL SHALE WASTE MATERIAL

[75] Inventors: Brij M. Moudgil, Gainsville, Fla.; David F. Messenger, Pomona, Calif.

[73] Assignee: Occidental Research Corporation, Irvine, Calif.

[ * ] Notice: The portion of the term of this patent subsequent to Sep. 25, 1996, has been disclaimed.

[21] Appl. No.: 36,637

[22] Filed: May 7, 1979

Related U.S. Application Data

[63] Continuation-in-part of Ser. No. 897,739, Apr. 19, 1978, Pat. No. 4,169,045.

[51] Int. Cl.[3] ..... B07C 5/02

[52] U.S. Cl. ..... 209/3.3; 209/578

[58] Field of Search ..... 209/3.1, 3.2, 3.3, 1, 209/3, 4, 9, 578

[56] References Cited

U.S. PATENT DOCUMENTS

| | | | |
|---|---|---|---|
| 1,678,884 | 7/1928 | Sweet | 209/3.1 |
| 2,967,614 | 1/1961 | Nury et al. | 209/3.1 |
| 3,346,111 | 10/1967 | Thompson | 209/9 |
| 3,356,211 | 12/1967 | Mathews | 209/3.1 |
| 3,472,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1976 | Sawyer | 209/3.1 |
| 4,169,045 | 9/1979 | Moudgil | 209/3.3 |

*Primary Examiner*—Allen N. Knowles

*Attorney, Agent, or Firm*—Robert A. Franks; Barry A. Bisson

[57] ABSTRACT

A method is disclosed for the separation of oil shale from run of mine (ROM) oil shale containing particles of oil shale and refuse, which comprises conditioning the ROM oil shale with a coupling agent capable of selectively coating the kerogen hydrocarbons in the particulate oil shale to the substantial exclusion of coating the non-hydrocarbonaceous refuse, which coupling agent is one or more compounds selected from the group consisting of an alcohol, at least one carboxylic acid, preferably containing from about 5 to about 28 carbon atoms and a ketone. Combined with said coupling agent is a fluorescent dye in a quantity to make the coated particles of oil shale fluoresce upon excitation to a degree sufficient to distinguish the coated oil shale particles from the substantially non-coated refuse. Exciting (e.g. as with ultraviolet light) the fluorescent dye coupled to the oil shale particles induces fluorescence and enables separating the fluorescing, coated oil shale particles from substantially non-fluorescing, non-coated refuse particles.

10 Claims, No Drawings

PROCESS FOR SEPARATING OIL SHALE WASTE MATERIAL

CROSS REFERENCE TO RELATED APPLICATION

This application is a continuation-in-part of our application Ser. No. 897,739 filed Apr. 19, 1978 now U.S. Pat. No. 4,169,045, issued on Sept. 25, 1979, which is incorporated herein by reference.

BACKGROUND OF THE INVENTION

The present invention relates to a method for the separation of oil shale from ROM oil shale. More particularly, it relates to a method for separating oil shale from slate, shale, limestone, fireclay, and boney shale present in ROM oil shale.

As presently mined, ROM oil shale contains many impurities such as slate, shale, limestone, fireclay, and boney shale in varying concentrations. These and various other impurities in the ROM oil shale are hereinafter referred to as refuse. There are no economically practical techniques for separating oil shale from refuse, or separating higher grade oil shale from lower grade oil shale.

SUMMARY OF THE INVENTION

In accordance with the present invention, there is provided a method for the separation of higher grade oil shale from ROM oil shale containing particles of higher grade oil shale, lower grade oil shale and refuse, which comprises conditioning the ROM oil shale (or any lower grade oil shale) with a coupling agent capable of selectively coating the particulate oil shale to the substantial exclusion of coating refuse, which coupling agent is one or more compounds selected from the group consisting of an alcohol, at least one carboxylic acid, preferably containing from about 5 to about 28 carbon atoms, and a ketone. Also added, preferably combined with said coupling agent, is a fluorescent dye in a quantity to make the coated particles of oil shale fluoresce upon excitation to a degree sufficient to distinguish the higher grade coated oil shale particles from the lesser coated, lower grade oil shale particles and the substantially non-coated refuse. The fluorescent dye coupled to the oil shale particles is excited to induce fluorescence and the fluorescing, higher grade coated oil shale particles are separated from the substantially non-fluorescing, refuse particles and the lesser intensity fluorescing, lower grade oil shale particles.

In some cases, a dye can be used which is not fluorescent, but which has a visible color and separation can be done by optical means including hand sorting. Additionally, a marking agent for providing a detectable marking to the coupling-agent-coated or the non-coated particles can be used.

It should be noted that the term "oil shale" as used in the industry is in fact a misnomer; it is neither shale, nor does it contain oil. It is a sedimentary formation comprising marlstone deposit and including dolomite with layers containing an organic polymer called "kerogen," which, upon heating, decomposes to produce liquid and gaseous products. It is the formation containing kerogen that is called "oil shale" herein, and the liquid carbonaceous product is called "shale oil."

As used herein, "higher grade" and "higher BTU" mean particles of economically significantly greater kerogen or "oil" content or fuel value (or carbon, including hydrocarbon, content) as compared to "lower grade" or "lower BTU" oil shale or "refuse" (which has substantially no economic value as source of oil.) It is to be understood that the distinction between higher and lower grade or BTU or oil content is a matter of economic choice. Once the economic choice (e.g. of a minimum BTU particle) is made, the sorting apparatus can be set to separate particles which possess a higher or lower fluorescent intensity than that chosen as the "cut-off point" corresponding to the intensity of a particle of the desired minimum oil content.

It should also be understood that the intensity cut-off point can be chosen so as to substantially separate refuse of substantially no fuel value from very low grade oil shale; however, the economic choice will more frequently be to separate higher oil content from lower oil content particles. For convenience, hereinafter, the process will be described as separation of refuse from ROM oil shale, but is intended to also describe to one of skill in the art how to separate higher from lower grade oil shale.

DETAILED DESCRIPTION OF THE INVENTION

According to the present invention, there is provided a method for the separation of refuse from ROM oil shale to recover oil shale therefrom. The practice of the method of this invention involves the separation of oil shale from the refuse present in the ROM oil shale. The ROM oil shale to be separated is conditioned with a coupling agent that will selectively coat the oil shale (or carbonaceous material) in a particle but will not coat the non-carbonaceous refuse. Combined with the coupling agent is a dye, preferably a fluorescent dye that is capable of fluorescence when excited. The fluorescent dye conditioned ROM oil shale is exposed to electromagnetic radiation to excite the fluorescent dye. The coated oil shale particles will fluoresce, whereupon they can be separated from the substantially non-coated, non-fluorescing refuse particles.

It should also be understood that a non-fluorescent dye or pigment which has a distinctive color in the visible range can be combined with the coupling agent, whereby the sorting can be done by eye or optical detection apparatus.

The method of the present invention is based upon the differences in surface chemical properties of the material present in ROM oil shale. Due to these differences, there can be utilized a coupling agent that will substantially, selectively coat only the carbonaceous oil shale present. By proper selection of coupling agent, the desirable oil shale in the ROM oil shale can be separated from the undesirable refuse. Surface chemical properties are relatively more consistent than other properties such as color, reflectance, or conductivity. These other properties tend to be similar for oil shale and refuse requiring a fine degree of resolution to distinguish between the oil shale and refuse. Such a degree of resolution is difficult to obtain and, therefore, the efficiency of separation based upon these properties suffers. Separation of material based upon the surface chemical properties is, therefore, more consistent than techniques based upon the above other properties.

To distinguish between the coupling agent coated oil shale and the non-coated material, there is incorporated with the coupling agent a marking agent, such as a fluorescent dye. Following coating of the ROM oil shale with the coupling agent and dye, the ROM oil shale can be radiated with electromagnetic radiation to cause the dye to fluoresce. The dye coupled with the oil shale by the coupling agent that is coating the oil shale will fluoresce to a substantial degree and the non-coated refuse material will essentially not fluoresce, thereby enabling the materials to be separated by differences in fluorescence.

Generally, fluorescence refers to the property of absorbing radiation at one particular wavelength and simultaneously re-emitting light of a different wavelength so long as the stimulus is active. It is intended in the present method to use the term fluorescence to indicate that property of absorbing radiation at one particular wavelength and re-emitting it at a different wavelength, whether or not visible, during exposure to an active stimulus or after exposure or during both these time periods. Thus, fluorescence is used generically herein to include fluorescence and phosphorescence, and envisions the emission of electromagnetic waves whether or not within the visible spectrum.

Electromagnetic radiation generally refers to the emission of energy waves of all the various wavelengths encompassed by the entire electromagnetic spectrum. It is intended in the present method to use the term electromagnetic radiation to indicate any and all stimuli that will excite and induce fluorescence of the fluorescent dye. Thus, electromagnetic radiation is used generically herein to include electromagnetic radiation and envisions other stimuli that will excite and induce fluorescence of the fluorescent dye.

The choice of a water-soluble or an oil-soluble dye is further decribed in Ser. No. 897,740 filed Apr. 19, 1978, of Brij M. Moudgil, titled "Separation of Limestone from Limestone Ore", now U.S. Pat. No. 4,208,272, issued June 17, 1980 (the entire disclosure of which is incorporated herein).

In general, if the coating on the oil shale (or carbonaceous material) is hydrophobic, an oil-soluble dye would be chosen to cause the oil shale to fluoresce; however, a water-soluble dye could be applied, which would preferentially coat the refuse in which case the higher grade oil shale would have a lower intensity and the refuse the higher fluorescence (or visible color).

The method of this invention is practiced in regard to oil shale by conditioning the ROM oil shale, following sizing, with a coupling agent or mixture of coupling agents that selectively adheres to the kerogen or to the refuse present in the ROM oil shale. It is preferred to condition the ROM oil shale with a mixture of coupling agents that selectively coats the carbonaceous matter of kerogen in the ROM oil shale. The coupling agents that are useful in separating kerogen are ketones, carboxylic acids, alcohols or mixtures thereof.

In practicing the present method, ROM oil shale is, in general, first subjected to a crushing step. The ROM oil shale is crushed to physically separate the oil shale from the refuse present. Crushing increases the surface area of the particles and further provides a greater surface and reactive site for the coating of the particles by the coupling agent and fluorescent dye. In this crushing step, the ROM oil shale as mined is crushed to a particle size of from about ¼ to about 8 inches. It is preferred to crush the ROM oil shale in particle sizes of from about ½ to 3 inches. Particles less than ¼ inch and greater than 8 inches can be used in the practice of the method of this invention. However, the coating and separation of ore particles of less than ¼ inch is less economically attractive and ore particles of greater than 8 inches entrain impurities so as to make the separation process less efficient. Following the crushing and sizing process, the ROM oil shale can be deslimed to remove soluble surface impurities and fines adhering to the surface of the particles.

Following the crushing and desliming steps, the ROM oil shale is conditioned with a coupling agent selected from one or more of the following: an alcohol or mixtures of alcohols, a ketone or mixture of ketones and a carboxylic acid or mixture of carboxylic acids, preferably containing from about 6 to about 28 carbon atoms. Preferably, the carboxylic acid is monocarboxylic, to produce a hydrophobic surface on the carbonaceous material in the particles. It is preferred to select at least one carboxylic acid containing from about 8 to about 18 carbon atoms. Acids of more than about 28 carbon atoms tend to be less selective in coating only the oil shale particles. Therefore, since acids of more than about 28 carbon atoms are not as selective in coating the particles in the ROM oil shale, the efficiency of the separation decreases. Acids of less than about 6 carbon atoms will generally be too water-soluble and, thus, can be washed-off and may not attach and hold a sufficient amount of dye.

It should be understood that the term "carboxylic acid" also includes salts of the carboxylic acids.

Coupling agents that are useful in the practice of this method to coat the hydrocarbon present in the oil shale particles include but are not limited to one or more compounds selected from the group consisting of an alcohol, a ketone, and at least one member selected from the saturated and unsaturated carboxylic acids including fatty acids which contain from about 5 to about 28 carbon atoms, or a mixture thereof. Carboxylic acids that can be used include palmitoleic acid, oleic acid, linoleic acid, caproic acid, caprylic acid, capric acid, lauric acid, myristic acid, palmitic acid, stearic acid, arachidic acid, behenic acid, tall oil fatty acids and the like.

Suitable ketones (e.g. methylisobutyl ketone) are those which are mutually compatable with the selected carboxylic acid or alcohol in a selected solvent or dispersant.

The preferred ketones include the ketoacids (e.g., B-acetoacetic acid) and ketones of the general formula $RR^1CO$ where R and $R^1$ can be the same or different and are selected from $C_1$–$C_{24}$ alkyl, $C_6$–$C_{14}$ aryl or alkyl aryl, or $C_5$–$C_{22}$ heterocyclic radicals (e.g. pyridine radical).

Alcohols which are suitable for use in the practice of this method are mutually compatable with the selected carboxylic acid or ketone, and preferably contain from about 6 to about 22 carbon atoms. Mixtures of alcohols and mixtures of alcohols and ketones can also be used.

Among the useful alcohols are those described in Ser. No. 897,779, Filed Apr. 19, 1978 and titled "Separation of Coal from Waste Material," an invention of Moudgil and Messenger, now U.S. Pat. No. 4,208,273 issued June 17, 1980, which is incorporated herein by reference.

The coupling agent is combined with a marking agent, preferably a fluorescent dye, to distinguish coated particles from uncoated particles. Fluorescent dyes known to those skilled in the art and which are compatible with the coupling agents can be used in the practice of the method of this invention. Many such fluorescent dyes are commercially available, such as fluoranthene and fluorescent yellow G, (product of Morton Norwich Chemical, Chicago) rhodamine B, flavine ff, uranine and the like. It is preferred that the fluorescent dye be water-insoluble, especially when the coupling agent is water-insoluble. Water-soluble fluorescent dyes can remain in the dispersant water used during the conditioning of the oil shale and can, therefore, be entrained in an aqueous surface coating on the refuse as well as combined with the coupling agent coating the oil shale. Thereby, the efficiency of distinguishing between the oil shale and refuse would be reduced. The preferred water-insoluble dyes remain combined with the coupling agent and are not attracted to the surface of the refuse particles.

The fluorescent dye can be combined with the coupling agent either before or after the ROM oil shale is conditioned with the coupling agent. The fluorescent dye can be used in any form, such as a solution, suspension, emulsion, dispersion or alone. The fluorescent dye can be combined with the coupling agent prior to conditioning the ROM oil shale by either mixing the fluorescent dye directly with the coupling agent or by mixing the fluorescent dye with a suitable diluent or solvent such as an oil, then mixing with the coupling agent. If the fluorescent dye is combined with the coupling agent following the conditioning of the ROM oil shale, it can be applied directly to the conditioned ROM oil shale or it can be used in one of the above forms such as by mixing the dye with the diluent or solvent, then applying it to the conditioned ore. The fluorescent dye has an affinity toward the coupling agent coating and will, therefore, be attracted to and entrained substantially on only the coated oil shale particles. Any dye that adheres to the refuse particles, generally, is rinsed off through a wash of the ROM oil shale. It is preferred to combine the coupling agent and fluorescent dye prior to conditioning the ROM oil shale. Such prior treatment uses less fluorescent dye, requires fewer steps and is generally more efficient both economically and in separation results.

To condition the ROM oil shale, the coupling agent is mixed with the sized ROM oil shale. The coupling agent can be dissolved in a suitable solvent, mixed with a dispersant such as water, or can be used alone. It is preferred to form a dispersion of the coupling agent in water. The aqueous dispersion is then contacted with the ROM oil shale. Many methods can be employed to contact the dispersion with the ROM oil shale. Such methods include, but are not limited to, spraying the dispersion onto the particles, passing the particles through a dispersion bath, and the like. It is preferred to spray the ROM oil shale particles with the dispersion of coupling agent in water. Such a spraying operation can consist of spraying the ROM oil shale particles as they pass on a belt or shaker bed. The ROM oil shale can also be passed through a ring sprayer or series of ring sprayers as in Ser. No. 897,946, filed Apr. 19, 1978, of Moudgil and Roeschlaub, titled "Method and Apparatus for Selective Wetting of Particles", the entire disclosure of which is hereby incorporated herein, to condition and coat the oil shale particles. The excess dispersion and that physically entrained in the particles can be washed from the ROM oil shale and used on a subsequent batch. Due to the surface chemical properties of the oil shale, the coupling agent selectively adheres to the oil shale and will coat the oil shale with a coating capable of fluorescence, which will allow the oil shale to be separated from the refuse present in the ROM oil shale.

Following the conditioning of the ROM oil shale, the ROM oil shale is exposed to electromagnetic radiation to cause the coating on the oil shale particles to fluoresce. The coated fluorescing particles can be separated from the non-fluorescing particles be many different means, such as by hand or by an optical sorting device such as the Matthews' apparatus taught by Matthews' U.S. Pat. No. 3,472,375, incorporated herein by reference. In the Matthews' apparatus, a free-falling mixture of ore passes in front of a row of detectors. Each detector by proper attenuation is capable of distinguishing between non-fluorescence and fluorescence or in degree of fluorescence. Each detector in turn controls one flowing fluid stream selectively directed transverse to the path of the falling particle, the fluid stream being permitted to impinge only on the properly emitting ore particles. The directed fluid stream deflects the ore particles into a divergent path by which they are separated from the undesired ore particles. Such an apparatus is capable of detecting and separating the coupling agent and dye-coated particles from the non-coated particles.

The invention is further illustrated by the following examples, which are not intended to be limiting.

EXAMPLE 1

A synthetic sample of light brown color oil shale (oil content less than 10 gal/ton) and dark color oil shale (oil content more than 20 gal/ton) was prepared. Both, light brown and dark color oil shale pieces were from Logan Wash #2. Percentage of dark color pieces in the sample was 35%.

After washing, the sample was conditioned with a reagent and a fluorescent dye combination. The reagent in the present case was oleic acid and MIBK (Methyl Isobutyl Ketone) and fluoranthene was used as a fluorescent dye. This mixture was dispersed in water for conditioning purposes. After conditioning, the sample was rinsed with water to remove any mechanically attached reagent. Separation of coated (dark color oil shale) from uncoated (light brown color oil shale) pieces was achieved using Matthews' separator apparatus as shown in U.S. Pat. No. 3,472,375 by passing free-falling particles of the ore in front of a radiating source and subsequently fluorescence detectors. The coated oil shale particles fluoresced substantially to a greater degree than the refuse when radiated. Each detector had been attenuated to detect the degree of fluorescence of the oil shale particles and each controlled one flowing fluid stream selectively directed transverse to the path of the falling particles. The fluid streams impinged only on the fluorescing oil shale particles. The directed fluid stream deflected the fluorescing oil shale particles on a divergent path from the free-falling, non-fluorescing refuse particles.

Hand sorting results of the separated fractions are summarized below:

| | |
|---|---|
| ° Reagent used: | Oleic acid + MIBK |
| ° Fluorescent dye used: | Fluoranthene |
| ° Component activated: | Dark color oil shale (high grade oil shale) |
| ° Particle size | 1 to 2 inches |
| ° Amount of dark color oil shale in the sample | 35% |
| ° Recovery of dark color rock in concentrate | 79% |
| ° Amount of light brown color | 15% |

-continued

| |
|---|
| rock in concentrate |

EXAMPLE 2

The procedure of Example 1 was repeated in all essential details except the coupling agent used was a fatty acid and methylisobutyl ketone.

The amount of high grade oil shale in the feed was 33%. The following table summarizes the results.

| MATERIAL | OIL, gallons/ton (Average) | RECOVERY OF HIGH GRADE |
|---|---|---|
| feed | 16 | |
| High Grade | 25 | 80% |
| Low Grade | 10 | |

The coupling agents of the present invention, comprising a carboxylic acid and ketone, can be used in combination with a visible dye or pigment (e.g. carbon black) and utilizing the separation techniques described in Ser. No. 897,947, filed on Apr. 19, 1978, by Brij Moudgil, Booker Morey and David Messenger, titled "A Method of Separating a Mixture of Ore Particles", now U.S. Pat. No. 4,235,708, issued Nov. 25, 1980, the entire disclosure of which is hereby incorporated herein.

Alcohols, or mixtures of ketones and alcohols, can be used in combination with a carboxylic acid substantially as described in the above examples.

This invention is particularly suitable for treating oil shale of the Rundle deposit in Australia, in which oil shale outcrops on the rim and extends, in four separate thick layers interbedded with waste or lean oil shale, from the surface to a total depth of 370 meters. That oil shale which can be surface mined can be crushed to the desired size, washed to remove soluble surface impurities and fines, then conditioned and the high grade shale separated from the low grade or waste oil shale (which can be more than 50% of the ROM oil shale) by a process as described above.

What is claimed is:

1. A process for the separation of oil shale from a run of mine (ROM) oil shale containing particles of oil shale and refuse, the process comprising the steps of:

(a) conditioning the ROM oil shale by contacting the ROM oil shale with a coupling agent capable of selectively coating the carbonaceous matter in the particulate oil shale to the substantial exclusion of coating refuse, which coupling agent comprises at least one alcohol containing from about 6 to about 22 carbon atoms, and at least one member selected from the group consisting of a ketone and a carboxylic acid containing from about 5 to about 28 carbon atoms;

(b) combining a coloring agent with the coating of coupling agent in a quantity sufficient to make the coated oil shale particles distinguishable from the substantially non-coated refuse particles; and (c) separating coloring agent and coupling agent coated oil shale particles from substantially non-coloring-agent and non-coupling-agent coated refuse particles.

2. A process for separating oil shale from a run of mine (ROM) oil shale containing particles of oil shale and refuse, the process comprising the steps of:

(a) treating particulate ROM oil shale by contacting the ROM oil shale with a detectable marking agent to coat said marking agent preferentially on only one class of particles in said ROM oil shale; and (b) separating particles coated with said marking agent from the treated non-coated particles in the ROM oil shale.

3. A process for separating oil shale particles from ROM oil shale containing particles of oil shale and refuse, the process comprising the steps of:

(a) treating particulate ROM oil shale by contacting the ROM oil shale with a coupling agent comprising at least one ketone and at least one carboxylic acid containing from about 5 to about 28 carbon atoms for selectively coating the particulate oil shale to the substantial exclusion of coating refuse particles;

(b) combining a detectable marking agent with the coatiing of coupling agent on the oil shale particles or combining a detectable marking agent with the non-coupling-agent coated particles to coat the non-coupling-agent coated particles with the marking agent; and (c) separating the particles coated with marking agent from the particles substantially not coated with marking agent in the treated ROM oil shale particles.

4. A process for the separation of higher grade oil shale from lower grade oil shale and refuse, present in particulate run of the mine (ROM) oil shale, said process comprising:

(a) conditioning particulate ROM oil shale by contacting the ROM oil shale with a mixture comprising at least one alcohol and at least one member selected from the group consisting of a ketone and an organic carboxylic acid, said mixture being capable of selectively adhering to the kerogen in the ROM oil shale particles to the substantial exclusion of adhering to the refuse;

(b) causing a fluorescent dye to adhere to the mixture coating the kerogen in the conditioned particles in a quantity sufficient to make the coated particles of oil shale fluoresce upon excitation to a degree sufficient to distinguish the conditioned higher grade oil shale from the conditioned lower grade oil shale and refuse;

(c) irradiating the conditioned particulate ROM oil shale to excite and induce sufficient fluorescence of the fluorescent dye to distinguish higher grade oil shale from lower grade oil shale and refuse; and (d) separating the fluorescing higher grade oil shale from lesser fluorescing lower grade oil shale and the substantially non-fluorescing refuse.

5. A process for the separation of higher grade oil shale from lower grade oil shale and refuse, present in particulate run of the mine (ROM) oil shale, said process comprising:

(a) conditioning particulate ROM oil shale by contacting the ROM oil shale with a mixture comprising an alcohol and an organic carboxylic acid, said mixture being capable of selectively adhering to the kerogen in the ROM oil shale particles to the substantial exclusion of adhering to the refuse;

(b) causing a fluorescent dye to adhere to the mixture coating the kerogen in the conditioned particles in a quantity sufficient to make the coated particles of oil shale fluoresce upon excitation to a degree sufficient to distinguish the higher grade oil shale from the lower grade oil shale and refuse;

(c) irradiating the conditioned particulate ROM oil shale to excite and induce sufficient fluorescence of the fluorescent dye to distinguish higher grade oil shale from lower grade oil shale and refuse; and (d) separating the fluorescing higher grade oil shale from the lesser fluorescing lower grade oil shale and the substantially non-fluorescing refuse.

6. A process for the separation of higher grade oil shale from lower grade oil shale and refuse, present in particulate run of the mine (ROM) oil shale, said process comprising:

(a) conditioning particulate ROM oil shale by contacting the ROM oil shale with a mixture comprising a ketone, an alcohol and an organic carboxylic acid, said mixture being capable of selectively adhering to the kerogen in the ROM oil shale particles to the substantial exclusion of adhering to the refuse;

(b) causing a fluorescent dye to adhere to the mixture coating the kerogen in the conditioned particles in a quantity sufficient to make the coated particles of oil shale fluoresce upon excitation to a degree sufficient to distinguish the conditioned higher grade oil shale from the conditioned lower grade oil shale and refuse;

(c) irradiating the conditioned particulate ROM oil shale to excite and induce sufficient fluorescence of the fluorescent dye to distinguish higher grade oil shale from lower grade oil shale and refuse; and (d) separating the fluorescing higher grade oil shale from the lesser fluorescing lower grade oil shale and the substantially non-fluorescing refuse.

7. A process for separating oil shale particles from ROM oil shale containing particles of oil shale and refuse, the process comprising the steps of:

(a) treating particulate ROM oil shale with a coupling agent comprising at least one alcohol containing from about 6 to about 22 carbon atoms and at least one carboxylic acid containing from about 5 to about 28 carbon atoms for selectively coating the particulate oil shale to the substantial exclusion of coating refuse particles;

(b) combining a detectable marking agent with the coating of coupling agent on the oil shale particles or combining a detectable marking agent with the non-coupling-agent coated particles; and (c) separating the particles combined with marking agent from the treated ROM oil shale particles.

8. A process as recited in claim 1 wherein the separating step comprises:

(a) passing the conditioned ROM oil shale particles in free-fall through a detection zone wherein a detector distinguishes between oil shale particles and refuse particles by detecting the coloring agent on the oil shale particles;

(b) deflecting the oil shale particles from the free-fall path by directing a fluid stream to impinge on the oil shale particles as they free fall; and (c) collecting the deflected oil shale particles and separately collecting the undeflected free-falling refuse particles.

9. A process as recited in claim 2, 3 or 7 wherein the separating step comprises:

(a) passing the treated ROM oil shale particles in free-fall through a detection zone wherein a detector distinguishes between oil shale particles and refuse particles by detecting marking agent on the particles;

(b) deflecting the particles coated with the marking agent from the free-fall path by directing a fluid stream to impinge on such particles coated with the marking agent; and (c) separately collecting the deflected, marking-agent-coated particles and the free-falling, non-marking-agent-coated particles.

10. A process for the separation of higher grade oil shale from lower grade oil shale and refuse, present in particulate run of the mine (ROM) oil shale, said process comprising:

(a) conditioning particulate ROM oil shale by contacting the ROM oil shale with a mixture comprising at least one alcohol and at least one member selected from the group consisting of a ketone and an organic carboxylic acid, said mixture being capable of selectively adhering to the kerogen in the ROM oil shale particles to the substantial exclusion of adhering to the refuse;

(b) causing a fluorescent dye to adhere to the mixture coating the kerogen in the conditioned particles in a quantity sufficient to make the coated particles of oil shale fluoresce upon excitation to a degree sufficient to distinguish the conditioned higher grade oil shale from the conditioned lower grade oil shale and refuse;

(c) passing the conditioned particulate ROM oil shale in free-fall through an irradiation zone;

(d) irradiating the conditioned particulate ROM oil shale with actinic radiation as it free-falls through the irradiation zone to excite and induce sufficient fluorescence of the fluorescent dye to distinguish higher grade oil shale from lower grade oil shale and refuse;

(e) detecting the intensity of fluorescence of each particle of ROM oil shale as it free-falls;

(f) separating the fluorescing higher grade oil shale from lesser fluorescing lower grade oil shale and the substantially non-fluorescing refuse by directing a fluid stream toward the free-falling ROM oil shale particle to impinge the fluid stream on the fluorescing higher grade oil shade to deflect the higher grade oil shale into a deflected fall path different from the free-fall path of travel of the lower grade oil shale and refuse; and (g) separately collecting the deflected falling higher grade oil shale and free-falling lower grade oil shale and refuse.

* * * * *

UNITED STATES PATENT AND TRADEMARK OFFICE

CERTIFICATE OF CORRECTION

PATENT NO. : 4,326,950
DATED : April 27, 1982
INVENTOR(S) : Brij M. Moudgil
David F. Messenger It is certified that error appears in the above-identified patent and that said Letters Patent are hereby corrected as shown below:

On The Title Page and Column 1,

The Title of the patent application "PROCESS FOR SEPARATING OIL SHALE WASTE MATERIAL" should read -- PROCESS FOR SEPARATING OIL SHALE FROM WASTE MATERIAL --. Column 6, line 5, "be" should read -- by --. Column 8, line 19, "coatiing" should read -- coating --.

Signed and Sealed this

*Twenty-third* Day of *November 1982*

[SEAL]

*Attest:*

GERALD J. MOSSINGHOFF

*Attesting Officer*

*Commissioner of Patents and Trademarks*